US007322328B2

(12) United States Patent
Haefner

(10) Patent No.: US 7,322,328 B2
(45) Date of Patent: Jan. 29, 2008

(54) VARIABLE CAM FOLLOWER FOR AN INTERNAL COMBUSTION ENGINE

(75) Inventor: Donald R. Haefner, Troy, MI (US)

(73) Assignee: Schaeffler KG, Herzogenaurach (DE)

( * ) Notice: Subject to any disclaimer, the term of this patent is extended or adjusted under 35 U.S.C. 154(b) by 126 days.

(21) Appl. No.: 11/293,705

(22) Filed: Dec. 2, 2005

(65) Prior Publication Data

US 2006/0118074 A1 Jun. 8, 2006

Related U.S. Application Data

(60) Provisional application No. 60/632,415, filed on Dec. 2, 2004.

(51) Int. Cl.
*F01L 1/14* (2006.01)

(52) U.S. Cl. ..... 123/90.48; 123/90.16; 123/90.15

(58) Field of Classification Search ..... 123/90.48, 123/90.55, 90.16, 90.15
See application file for complete search history.

(56) References Cited

U.S. PATENT DOCUMENTS 6,948,462 B2 * 9/2005 Engelberg ..... 123/90.12

FOREIGN PATENT DOCUMENTS

DE 42 02 507 8/1992

* cited by examiner

*Primary Examiner*—Zelalem Eshete
(74) *Attorney, Agent, or Firm*—Volpe and Koenig, PC

(57) ABSTRACT

A variable cam follower (1) is provided for changeable transmission of a lifting movement of a cam to valve train elements allocated to the cam follower (1) in an internal combustion engine. The cam follower (1) includes a hydraulic force transmission device (19) with a variable length pressure space (18), which is bounded by a hollow cylindrical recess (15) of a first cam follower part (3) and by a rod (16) guided in the hollow cylindrical recess (15). The rod is part of a second cam follower part (9) that can move telescopically relative to the first cam follower part (3). The pressure space (18) is closable by a slide (21*a*, 21*b*) arranged within the cam follower (1) and acted upon by an adjustable control pressure (p), wherein an opening (23), which extends from the pressure space (18) and opens into a channel (20*a*, 20*b*), in which the slide (21*a*, 21*b*) runs, is formed in a base (13) of the hollow cylindrical recess (15).

11 Claims, 2 Drawing Sheets

VARIABLE CAM FOLLOWER FOR AN INTERNAL COMBUSTION ENGINE

FIELD OF THE INVENTION

The invention relates to a variable cam follower, which is used for changeable transmission of a lifting movement of a cam to valve train elements allocated to the cam follower in an internal combustion engine. The cam follower features a hydraulic force transmission device with a variable length pressure space, which is bounded by a hollow cylindrical recess of a first cam follower part and by a rod of a second cam follower part, which can move telescopically relative to the first cam follower part and which is guided in the hollow cylindrical recess. In this way, the pressure space can be sealed by a slide that is arranged within the cam follower and that is acted upon by an adjustable control pressure.

BACKGROUND

A cam follower of this type is described in DE 42 02 507 A1. In this document, a bucket tappet with a cup-shaped piston and a valve-side piston is presented, between which a pressure space is bounded as a component of a hydraulic force transmission device. A lifting stroke of a cam acting on the bucket tappet is varied by the transmission of the movement by the bucket tappet to a gas-exchange valve of the internal combustion engine, such that the pressure space can be changed in its length as a function of the operating parameters of the internal combustion engine. In the mentioned document, this is realized in that a slide controlled by a control pressure as a function of these operating parameters closes or opens a connection of the pressure space to the bucket tappet surroundings. Consequently, the movement of the cam should be transmitted completely to the gas-exchange valve for the case that the pressure space is sealed by the slide. Otherwise, a lifting stroke starting from the cam can be reduced, such that a relative movement relative to the valve-side piston is enabled for the cup-shaped piston, in that when the slide is open, hydraulic medium can escape out of the pressure space into the bucket tappet surroundings.

Although this arrangement allows a continuous variation of the transmission of the lifting stroke from the cam to the gas-exchange valve up to its complete switch-off with comparatively simple means, its reduction to practice depends on, in particular, how much the need for essential freedom from vibrations in the valve train can be brought into line with the achievable stiffness of the hydraulic force transmission device. In addition to the existence of air or gas bubbles, which is, for the most part, unavoidable, the disadvantage for the hydraulic stiffness is a pressure space with a large volume for a comparatively small pressure transmission area. This ratio relevant for the stiffness is unfavorable in the cited document to the extent that the slide is arranged at a comparatively large distance to the valve-side piston, so that an additional hydraulic medium channel to the slide is required. However, this hydraulic medium channel does not contribute directly to the force transmission of the hydraulic force transmission device, but instead merely increases the volume of the pressure space by a stiffness-reducing dead space volume.

SUMMARY

Therefore, the invention is based on the objective of avoiding this mentioned disadvantage and thus creating a variable cam follower of the type named above, whose hydraulic force transmission device features the best possible hydraulic stiffness.

According to the invention, this objective is met in that in a base of the hollow cylindrical recess, an opening is formed, which starts from the pressure space and opens into a channel, in which the slide runs. Thus, the previously mentioned disadvantage is overcome with simple means. Through the arrangement of the slide in the direct vicinity of the pressure space, this space is characterized by the greatest possible compactness and is essentially free from dead space volumes, which reduce the stiffness of the hydraulic force transmission device. Thus, a cam follower with high variability can be presented, whose stiffness is comparable with those of mechanical transmission elements.

In a useful configuration of the invention, the pressure space should be in fluid connection with a hydraulic medium reservoir, which is arranged within the cam follower, when the opening is open. Consequently, the hydraulic medium forced from the pressure space in the case of decreasing cam lifting stroke is not pushed out into the cam follower surroundings when the movement of the cam is transmitted to adjacent valve train elements, but instead remains in the hydraulic medium reservoir formed within the cam follower.

In this way, first there is the possibility of arranging short hydraulic lines between the pressure space and the hydraulic medium reservoir within the cam follower. These lines enable a low-resistance displacement of hydraulic medium from the pressure space and are simultaneously necessary for a complete and delay-free refilling of the pressure space when the cam is moving away, i.e., when the cam lifting stroke is becoming smaller. Second, through the internal hydraulic medium reservoir, the necessity of pushing hydraulic medium displaced out of the pressure space into the cam follower surroundings and thus preferably into its hydraulic medium supply line and the necessity of drawing this hydraulic medium back into the pressure space is eliminated. In this case, through the cyclical displacement of hydraulic medium into the hydraulic medium supply line and its drawing out of this supply line, there exists an increased risk that impermissibly high pressure fluctuations could be generated in the hydraulic medium supply system of the cam follower. These fluctuations could negatively affect the pressure means and lubricant supply of adjacent cam followers, as well as the entire internal combustion engine, in an undesired way. Thus, it would be conceivable, for example, that the pressure fluctuations are transmitted to a regulator of the control pressure for the slide, such that a controlled slide movement is disturbed partially or completely. This additionally would result in an uncontrolled movement profile of the valve train with corresponding disruptions in the gas exchange process.

It is further provided that the hydraulic medium reservoir features a variable volume and is bounded by a piston supported in the cam follower part and variable in length relative to the cam follower part. In terms of a fast and complete refilling of the pressure space when the cam moves away, here it is especially useful to apply an initial pressure to the hydraulic medium reservoir, in that a spring acts on the piston in the direction of a volume reduction of the hydraulic medium reservoir. In this way, it presents itself that the spring is identical to the so-called lost-motion spring of the cam follower, which exerts force on the first cam follower part and the second cam follower part in the sense of displacing the cam follower.

According to another configuration of the invention, the slide should be forced against a restoring means by the control pressure, such that the opening is sealed by the slide at low control pressure and is open at high control pressure. This arrangement permits, in particular, a complete transmission of the cam lifting stroke to the gas-exchange valve already at the startup of the internal combustion engine, because in this operating phase, typically there is not a sufficiently high hydraulic medium pressure for controlling the slide and this arrangement merely keeps the pressure space closed through the force of the restoring means.

As a function of the valve train variability to be achieved in interaction with the operating strategy of the internal combustion engine, it can also be useful, alternatively, to charge the slide by the control pressure against a restoring means, such that the opening is open at low control pressure and is closed by the slide at high control pressure.

Finally, for reducing the valve train friction, it is proposed that the cam follower features a rotating and optionally roller-supported roller as a contact surface for the cam.

Finally, the inventive concept can also be transferred to solutions to be included in the protective scope of the invention, in which additional valve train elements for transmitting the cam motion are located between the cam and cam follower. This also includes, explicitly, such configurations of valve train elements, which are supported stationary in the internal combustion engine, for example, as pivot supports for finger levers, and which feature a hydraulic force transmission device in the sense of the invention.

BRIEF DESCRIPTION OF THE DRAWINGS

Additional features of the invention follow from the description below and from the drawings, in which embodiments of the invention are shown in simplified form. In the drawings.

DETAILED DESCRIPTION OF THE DRAWINGS

Figure 1:
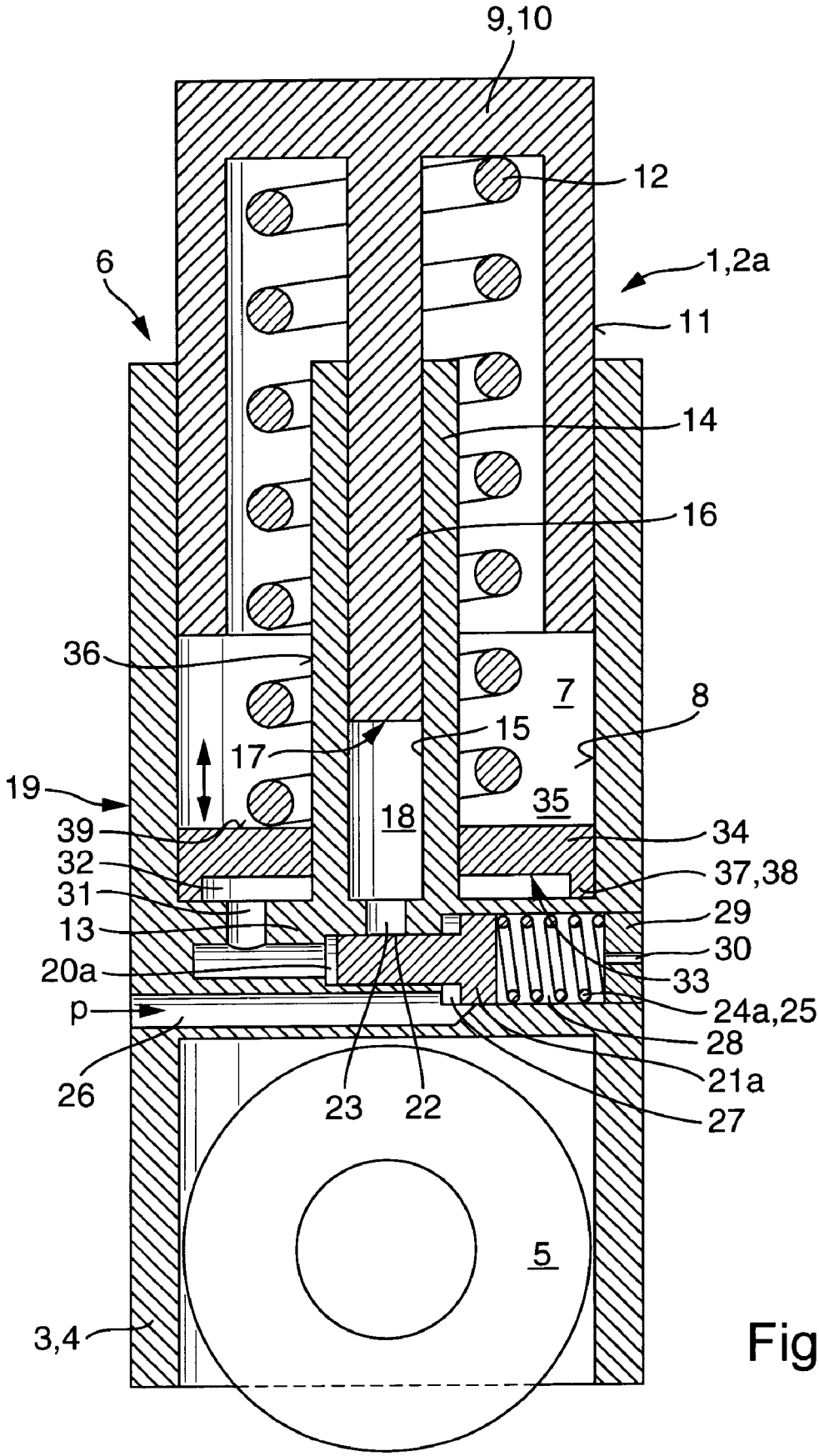
FIG. 1 is a longitudinal section view through a variable cam follower formed as a roller tappet with a first embodiment of a control for the slide and FIG. 2 is a view of the roller tappet according to FIG. 1 with a second embodiment of a control for the slide.

In FIG. 1, the cam follower 1 according to the invention for the valve train of an internal combustion engine is presented using the example of a roller tappet 2*a*. This includes a first cam follower part 3 in the form of an outer part 4, which is supported so that it can move longitudinally in a guide of the internal combustion engine. The outer part 4, with a sliding or roller supported roller 5, is in low-friction contact with a cam of the internal combustion engine. A section 6 of the outer part 4 opposite the roller 5 features a hollow cylindrical recess 7, in whose inner casing surface 8 a second cam follower part 9, which is formed in the embodiment as an inner part 10, is guided with an outer casing surface 11 so that it can move longitudinally relative to the outer part 4. The cam follower parts 3, 9 that can move telescopically relative to each other are acted upon by the force of a spring 12 in the sense of extending the cam follower 1.

Starting from a base 13 of the outer part 4, a column 14 with a hollow cylindrical recess 15 extends in the direction of the inner part 10 for holding a rod 16 extending from the inner part 10 so that it can move longitudinally. In this way, a pressure space 18 of a hydraulic force transmission device 19 of the cam follower 1 is formed by the hollow cylindrical recess 15 between the column 14 and one end 17 of the rod 16.

In the base 13 of the outer part 4, a channel 20*a* extends with a cylindrical slide 21*a* arranged therein. As a function of the position of the slide 21*a* in the channel 20*a*, the pressure space 18 is opened or closed, such that an outer casing surface 22 of the slide 21*a* opens or blocks an opening 23, which is formed in the base 13 and which starts from the pressure space 18 and opens into the channel 20*a*. If the pressure space 18 is closed, as is the case in the position of the slide 21*a* shown in FIG. 1, the hydraulic medium enclosed in the pressure space 18 transfers the movement of the outer part 4 driven by the cam to the rod 16 of the inner part 10 and thus to adjacent valve train elements, which are in active connection with the inner part 10.

The slide 21*a* is acted upon in a direction opposite a restoring means 25 formed as a coil compression spring 24*a* by a control pressure "p", which is fed via a control pressure channel 26 formed in the base 13 of the outer part 4 in a ring space 27, which is formed by the channel 20*a* and by the slide 21*a* and which lies opposite a spring space 28 for the coil compression spring 24*a*. In this way, in the outer part 4 there is a bushing 29, which is used for supporting the coil compression spring 24*a* and also for venting the spring space 28 via an opening 30.

The slide 21*a* is controlled by setting the control pressure "p" as a function of operating parameters of the internal combustion engine. In this way, the position of the slide 21*a* is set according to the force originating from the control pressure "p" as a ratio to the force of the coil compression spring 24*a*. For the first control variant of the slide 21*a*, for a sufficiently small control pressure "p" this slide is located in the position shown in FIG. 1, in which the pressure space 18 is closed. For a sufficiently high control pressure "p" the slide 21*a* moves against the force of the coil compression spring 24*a*—to the right in the illustration according to FIG. 1—and opens the pressure space 18. In this way, the effect of the hydraulic force transmission device 19 is influenced, such that a transmission of the movement of the outer part 4 to the inner part 10 is interrupted partially or completely in the sense of reducing the lifting stroke of the cam by the roller tappet 2*a*, in that the hydraulic medium located in the pressure space 18 is displaced via the channel 20*a* and a passage 31 in the base 13 into a hydraulic medium reservoir 32.

The hydraulic medium reservoir 32 is bounded in the illustrated embodiment by a bottom side 33 of a piston 34, which faces the base 13 of the outer part 4 and which is guided in an annular space 35 between the inner casing surface 8 of the outer part 4 and an outer casing surface 36 of the column 14 like a sealed gap and so that it can move longitudinally. In this way, the hydraulic medium reservoir 32 features a variable volume for holding hydraulic medium, which is displaced from the pressure space 18. In this way, the piston 34 is moved away from the base 13 by a lifting stroke, which corresponds to a volume of the hydraulic medium displaced from the pressure space 18. A minimum volume of the hydraulic medium reservoir 32 is set according to the shown figures, such that a collar 38 of the piston 34 acting as a stop 37 contacts the base 13.

An initial pressure, which is beneficial for fast and complete return flow of hydraulic medium from the hydraulic medium reservoir 32 into the pressure space 18, is generated in the hydraulic medium reservoir 32, such that the spring means 12 is supported between the inner part 10 and the outer part 4 on an upper side 39 of the piston 34 in the direction of reducing the volume of the hydraulic medium reservoir 32.

Figure 2:
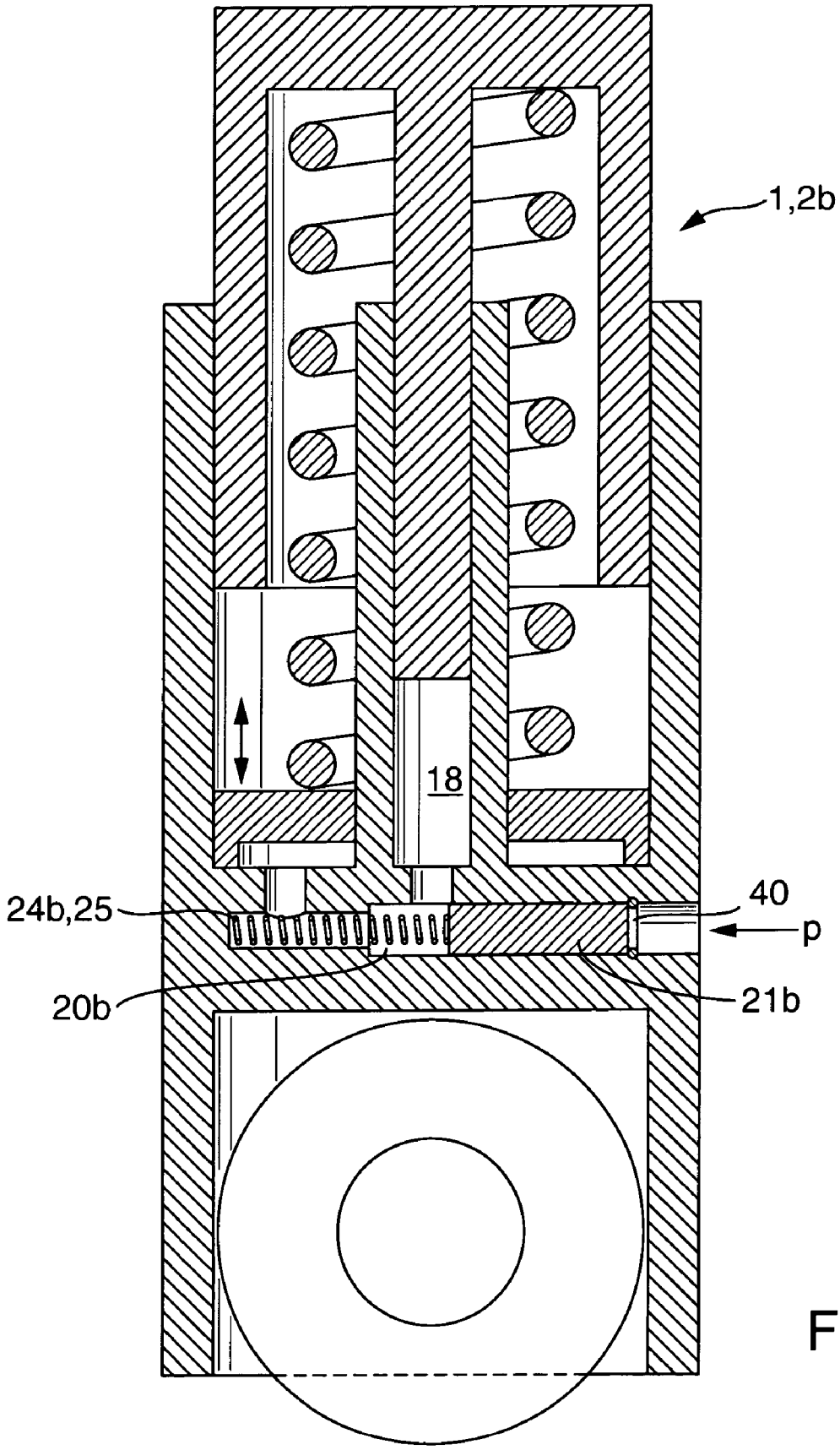

The cam follower 1 presented in FIG. 2 and likewise configured as a roller tappet 2*b* includes a second embodiment of a control for a slide 21*b*. In this respect, the following description is limited to the features, which differ from FIG. 1 and which relate exclusively to the control of the slide 21*b*. In this control embodiment, the control pressure "p" acting on the slide 21*b*, as well as a restoring means 25 likewise configured as a coil compression spring 24*b*, act on the slide 21*b*, such that the pressure space 18 is open for a low control pressure "p" and is closed for a high control pressure "p". In this way, an annular body 40 mounted in a channel 20*b* acts as an axial path limit for the slide 21*b*.

The invention claimed is:

1. Variable cam follower, used for changeable transmission of a lifting movement of a cam to valve train elements allocated to the cam follower in an internal combustion engine, comprising first and second cam follower parts assembled to form a tappet that is adapted to move longitudinally in a guide of the internal combustion engine, a hydraulic force transmission device with a variable length pressure space, which is bounded by a hollow cylindrical recess of the first cam follower part and by a rod of the second cam follower part which is guided in the hollow cylindrical recess to allow telescopic movement relative to the first cam follower part, wherein the pressure space is closeable by a slide, which is arranged within the cam follower and which is acted upon by an adjustable control pressure, an opening, which extends from the pressure space and opens into a channel, in which the slide runs, is formed in a base of the hollow cylindrical recess.

2. Cam follower according to claim 1, wherein for an open opening, the pressure space is in fluid connection with a hydraulic medium reservoir arranged within the cam follower.

3. Cam follower according to claim 2, wherein the hydraulic medium reservoir has a variable volume and is bounded by a piston, which is supported in the first cam follower part and can move longitudinally relative to the first cam follower part.

4. Cam follower according to claim 3, wherein the piston is acted upon by a spring in a direction of reducing a volume of the hydraulic medium reservoir.

5. Cam follower according to claim 4, wherein the spring acts upon the first cam follower part and the second cam follower part for extending the cam follower.

6. Cam follower according to claim 1, wherein the slide is acted upon by the control pressure against a restoring means, such that the opening is closed by the slide for a low control pressure and is opened for a high control pressure.

7. Cam follower according to claim 1, wherein the slide is acted upon by the control pressure against the restoring means, such that the opening is open for a low control pressure (p) and is closed by the slide (21*b*) for a high control pressure.

8. Cam follower according to claim 1, wherein the cam follower includes a rotating and optionally roller-supported roller as a contact surface for the cam.

9. Variable cam follower, used for changeable transmission of a lifting movement of a cam to valve train elements allocated to the cam follower in an internal combustion engine, comprising a hydraulic force transmission device with a variable length pressure space, which is bounded by a hollow cylindrical recess of a first cam follower part and by a rod of a second cam follower part which is guided in the hollow cylindrical recess to allow telescopic movement relative to the first cam follower part, wherein the pressure space is closeable by a slide, which is arranged within the cam follower and which is acted upon by an adjustable control pressure, an opening, which extends from the pressure space and opens into a channel, in which the slide runs, is formed in a base of the hollow cylindrical recess, when the opening is open, the pressure space is in fluid connection with a hydraulic medium reservoir arranged within the cam follower, and the hydraulic medium reservoir has a variable volume and is bounded by a piston, which is supported in the first cam follower part and can move longitudinally relative to the first cam follower part.

10. Cam follower according to claim 9, wherein the piston is acted upon by a spring in a direction of reducing a volume of the hydraulic medium reservoir.

11. Cam follower according to claim 10, wherein the spring acts upon the first cam follower part and the second cam follower part for extending the cam follower.

* * * * *